US006351246B1

(12) United States Patent
McCorkle

(10) Patent No.: US 6,351,246 B1
(45) Date of Patent: Feb. 26, 2002

(54) PLANAR ULTRA WIDE BAND ANTENNA WITH INTEGRATED ELECTRONICS

(75) Inventor: John W. McCorkle, Laurel, MD (US)

(73) Assignee: XtremeSpectrum, Inc., Greenbelt, MD (US)

( * ) Notice: Subject to any disclaimer, the term of this patent is extended or adjusted under 35 U.S.C. 154(b) by 0 days.

(21) Appl. No.: 09/563,292

(22) Filed: May 3, 2000

Related U.S. Application Data

(60) Provisional application No. 60/132,176, filed on May 3, 1999.

(51) Int. Cl.[7] ..... H01Q 9/28

(52) U.S. Cl. ..... 343/795; 343/810; 343/816; 343/853; 343/786

(58) Field of Search ..... 343/793, 795, 343/846, 853, 859, 865, 731, 767, 732, 810, 816, 786

(56) References Cited

U.S. PATENT DOCUMENTS

| | | | |
|---|---|---|---|
| 2,671,896 A | 3/1954 | De Rosa | |
| 2,999,128 A | 9/1961 | Hoeppner | |
| 3,587,107 A | 6/1971 | Ross | |

(List continued on next page.)

FOREIGN PATENT DOCUMENTS

| | | | |
|---|---|---|---|
| DK | 197 29 664 | 2/1999 | ..... H01Q/1/38 |
| WO | WO 84/02038 | 5/1984 | ..... H01Q/9/28 |

OTHER PUBLICATIONS

Ultra–Wideband Impulse Electromagnetic Scattering Laboratory, Michael A. Morgan, Proceedings of an International Conference on Ultra–Wideband, Short–Pulse Electromagnetics, held Oct. 8–10, 1992, at WRI, Polytechnic University, Brooklyn, NY, Ultra–Wideband, Short–Pulse Electromagnetics, Edited by H. Bertoni et al, Plenum Press, 1993, pp. 75–82.

Impulse Radiating Antennas, Carl E. Baum et al, Proceedings of an International Conference on Ultra–Wideband, Short–Pulse Electromagnetics, held Oct. 8–10, 1992, at WRI, Polytechnic University, Brooklyn, NY, Ultra–Wideband, Short–Pulse Electromagnetics, Edited by H. Bertoni et al, Plenum Press, 1993, pp. 139–147.

(List continued on next page.)

*Primary Examiner*—Don Wong
*Assistant Examiner*—Hoang Nguyen
(74) *Attorney, Agent, or Firm*—Oblon, Spivak, McClelland, Maier & Neustadt, P.C.

(57) ABSTRACT

An planar ultra wide bandwidth (UWB) antenna that provides integration of electronics is disclosed. The antenna has a first balance element that is connected to a terminal at one end. A second balance element is connected to another terminal at one end. The second balance element has a shape that mirrors the shape of the first balance element such that there is a symmetry plane where any point on the symmetry plane is equidistant to all mirror points on the first and second balance elements. Each of the balance elements is made of a generally conductive material. A triangular shaped ground element is situated between the first balance element and the second balance element with an axis of symmetry on the symmetry plane, and oriented such that the base of the triangle is towards the terminals. Accordingly, the ground element and each of the balance elements form two tapered gaps which widen and converge at the apex of the ground element as the taper extends outwardly from the terminals. Under this arrangement, sensitive UWB electronics can be housed within the perimeter of the ground element, thereby eliminating transmission line losses and dispersion, and minimizing and system ringing. A resistive loop connected between the first and second balance elements extends the low frequency response and improves the VSWR. A connection of an array of elements is disclosed that provides a low-frequency cutoff defined by the array size rather than the element size.

20 Claims, 13 Drawing Sheets

U.S. PATENT DOCUMENTS 3,612,899 A 10/1971 Ross
3,659,203 A 4/1972 Ross et al.
3,662,316 A 5/1972 Robbins
3,668,639 A 6/1972 Harmuth
3,678,204 A 7/1972 Harmuth
3,705,981 A 12/1972 Harmuth
3,728,632 A 4/1973 Ross
3,739,392 A 6/1973 Ross et al.
3,772,697 A 11/1973 Ross
3,794,996 A 2/1974 Robbins et al.
3,806,795 A 4/1974 Morey
3,878,749 A 4/1975 Woron
3,934,252 A 1/1976 Ross et al.
3,995,212 A 11/1976 Ross
4,017,854 A 4/1977 Ross
4,072,942 A 2/1978 Alongi
4,099,118 A 7/1978 Franklin et al.
4,152,701 A 5/1979 Mara et al.
4,254,418 A 3/1981 Cronson et al.
4,344,705 A 8/1982 Kompa et al.
4,473,906 A 9/1984 Warnaka et al.
4,506,267 A 3/1985 Harmuth
4,641,317 A 2/1987 Fullerton
4,651,152 A 3/1987 Harmuth
4,688,041 A 8/1987 Cronson et al.
4,695,752 A 9/1987 Ross et al.
4,698,633 A 10/1987 Lamensdorf et al.
4,743,906 A 5/1988 Fullerton
4,751,515 A 6/1988 Corum
4,813,057 A 3/1989 Fullerton
4,862,174 A 8/1989 Natio et al.
4,907,001 A 3/1990 Harmuth
4,979,186 A 12/1990 Fullerton
5,057,846 A 10/1991 Harmuth
5,068,671 A * 11/1991 Wicks et al. ..... 343/799
5,090,024 A 2/1992 Vander Mey et al.
5,095,312 A 3/1992 Jehle et al.
5,134,408 A 7/1992 Harmuth
5,146,616 A 9/1992 Tang et al.
5,148,174 A 9/1992 Harmuth
5,153,595 A 10/1992 Harmuth
5,159,343 A 10/1992 Harmuth
5,177,486 A 1/1993 Kim et al.
5,216,429 A 6/1993 Nakagawa et al.
5,216,695 A 6/1993 Ross et al.
5,223,838 A 6/1993 Tang et al.
5,227,621 A 7/1993 Kim et al.
5,237,586 A 8/1993 Bottomley
5,239,309 A 8/1993 Tang et al.
5,248,975 A 9/1993 Schutz
5,274,271 A 12/1993 McEwan
5,307,079 A 4/1994 Ross et al.
5,307,081 A 4/1994 Harmuth
5,313,056 A 5/1994 Kim et al.
5,319,218 A 6/1994 Kim et al.
5,323,169 A 6/1994 Koslover
5,332,938 A 7/1994 McEwan
5,337,054 A 8/1994 Ross et al.
5,345,471 A 9/1994 McEwan
5,351,053 A * 9/1994 Wicks et al. ..... 342/158
5,352,974 A 10/1994 Heger
5,353,301 A 10/1994 Mitzlaff
5,359,624 A 10/1994 Lee et al.
5,361,070 A 11/1994 McEwan
5,363,108 A 11/1994 Fullerton
5,365,240 A 11/1994 Harmuth
5,377,225 A 12/1994 Davis
5,381,151 A 1/1995 Boles et al.
5,389,939 A 2/1995 Tang et al.
5,422,607 A 6/1995 McEwan
5,428,364 A 6/1995 Lee et al. ..... 343/767
5,455,593 A 10/1995 Ross
5,457,394 A 10/1995 McEwan
5,465,094 A 11/1995 McEwan
5,471,162 A 11/1995 McEwan
5,479,120 A 12/1995 McEwan
5,486,833 A 1/1996 Barrett
5,493,691 A 2/1996 Barrett
5,495,499 A 2/1996 Fenton et al.
5,510,800 A 4/1996 McEwan
5,512,834 A 4/1996 McEwan
5,517,198 A 5/1996 McEwan
5,519,342 A 5/1996 McEwan
5,519,400 A 5/1996 McEwan
5,521,600 A 5/1996 McEwan
5,523,758 A 6/1996 Harmuth
5,523,760 A 6/1996 McEwan
5,523,767 A 6/1996 McCorkle ..... 343/810
5,533,046 A 7/1996 Lund
5,543,799 A 8/1996 Heger
5,563,605 A 10/1996 McEwan
5,568,522 A 10/1996 Hershey et al.
5,573,012 A 11/1996 McEwan
5,576,627 A 11/1996 McEwan
5,581,256 A 12/1996 McEwan
5,586,145 A 12/1996 Morgan et al.
5,589,838 A 12/1996 McEwan
5,592,177 A 1/1997 Barrett
5,594,456 A 1/1997 Norris et al.
5,596,601 A 1/1997 Bar-David
5,602,964 A 2/1997 Barrett
5,606,331 A 2/1997 McCorkle ..... 343/786
5,609,059 A 3/1997 McEwan
5,610,611 A 3/1997 McEwan
5,610,907 A 3/1997 Barrett
5,623,511 A 4/1997 Bar-David et al.
5,627,856 A 5/1997 Durrant et al.
5,630,216 A 5/1997 McEwan
5,633,889 A 5/1997 Schilling
5,640,419 A 6/1997 Janusas
5,648,787 A 7/1997 Ogot et al.
5,654,978 A 8/1997 Vanderpool et al.
5,659,572 A 8/1997 Schilling
5,661,385 A 8/1997 McEwan
5,661,490 A 8/1997 McEwan
5,673,050 A 9/1997 Moussally et al.
5,673,286 A 9/1997 Lomp
5,677,927 A 10/1997 Fullerton et al.
5,682,164 A 10/1997 McEwan
5,687,169 A 11/1997 Fullerton
5,748,891 A 5/1998 Fleming et al.
5,880,699 A 3/1999 McCorkle ..... 343/840
6,049,309 A 4/2000 Timoshin et al. .... 343/700 MS
5,361,070 C1 5/2000 McEwan
H1877 H * 10/2000 Vanetten et al. ..... 342/188
H1913 H * 11/2000 Vanetten et al. ..... 343/705

OTHER PUBLICATIONS

Accurate Modeling of Antennas for Radiating Short Pulses, FDTD Analysis and Experimental Measurements, James G. Maloney et al, Proceedings of an International Conference on Ultra–Wideband, Short–Pulse Electromagnetics, held Oct. 8–10, 1992, at WRI, Polytechnic University, Brooklyn, NY, Ultra–Wideband, Short–Pulse Electromagnetics, Edited by H. Bertoni et al, Plenum Press, 1993, pp. 149–156.

Wide–Bandwidth Radiation From Arrays of Endfire Tapered Slot Antennas, Daniel H. Schaubert, Proceedings of an International Conference on Ultra–Wideband, Short–Pulse Electromagnetics, held Oct. 8–10, 1992, at WRI, Polytechnic University, Brooklyn, NY, Ultra–Wideband, Short–Pulse Electromagnetics, Edited by H. Bertoni et al, Plenum Press, 1993, pp. 157–165.

Polarization Diverse Ultra–Wideband Antenna Technology, Michael C. Wicks et al, Proceedings of an International Conference on Ultra–Wideband, Short–Pulse Electromagnetics, held Oct. 8–10, 1992, at WRI, Polytechnic University, Brooklyn, NY, Ultra–Wideband, Short–Pulse Electromagnetics, Edited by H. Bertoni et al, Plenum Press, 1993, pp. 177–187.

Wideband Circularly Polarized Aperture–Coupled Microstrip Antennas, S. D. Targonski et al, Proceedings of an International Conference on Ultra–Wideband, Short–Pulse Electromagnetics, held Oct. 8–10, 1992, at WRI, Polytechnic University, Brooklyn, NY, Ultra–Wideband, Short–Pulse Electromagnetics, Edited by H. Bertoni et al, Plenum Press, 1993, pp. 189–194.

World's Fastest Solid–State Digitizer, Energy & Technology Review, Apr., 1994, McEwan et al, pp. 1–6.

Radar Technology May Held Improve Automobile Safety, Tuesday's Newsline, Tuesday, Mar. 29, 1994, vol. 19., No. 22.

Single–Shot Transient Digitizer (1993), Inventor Thomas McEwan Motion Detector Technology, Inventor: Thomas McEwan.

Low–Power, Miniature, Distributed Position Location and Communication Devices Using Ultra–Wideband, Nonsinusoidal Communication Technology, Advanced Research Projects Agency/Federal Bureau of Investigation, Jul. 1995, pp. 1–40.

A Resistively Loaded, Printed Circuit, Electrically Short Dipole Element For Wideband Array Applications, Randolph E. Clapp, Proceedings of the Antennas and Propagation Society International Symposium (APSIS), Ann Arbor, Michigan Jun. 28–Jul. 2, 1993 (Jun. 6, 28) pp. 478–481.

A Broadband Free–Space Millimeter–Wave Vector Transmission Measurement System, Y. Konishi et al, IEE Transactions on Microwave Theory and Techniques, IEE Inc. New York, US, vol. 42, No. 7, Part 1, Jul. 1, 1994, pp. 1131–1139.

* cited by examiner

PLANAR ULTRA WIDE BAND ANTENNA WITH INTEGRATED ELECTRONICS

CROSS-REFERENCES TO RELATED APPLICATION

This application is related to, and claims the benefit of the earlier filing date of, U.S. Provisional Patent Application Ser. No. 60/132,176, filed May 3, 1999, entitled "Planar UWB Antenna with Integrated Transmitter and Receiver Circuits," the entirety of which is incorporated herein by reference.

BACKGROUND OF THE INVENTION

1. Field of the Invention

The present invention relates generally to antenna apparatuses and systems, and more particularly, to planar antennas with non-dispersive, ultra wide bandwidth (UWB) characteristics.

2. Discussion of the Background

With respect to the antenna of radar and communications systems, there are five principle characteristics relative to the size of the antenna: the radiated pattern in space versus frequency, the efficiency versus frequency, the input impedance versus frequency, and the dispersion. Typically, antennas operate only with a few percent bandwidth, and bandwidth is defined to be a contiguous band of frequencies in which the VSWR (voltage standing wave ratio) is below 2:1. In contrast, ultra wide bandwidth (UWB) antennas provide significantly greater bandwidth than the few percent found in conventional antennas, and exhibits low dispersion. For example, as discussed in Lee (U.S. Pat. No. 5,428,364) and McCorkle (U.S. Pat. Nos. 5,880,699, 5,606,331, and 5,523,767), UWB antennas can cover 5 or more octaves of bandwidth without dispersion. A discussion of other UWB antennas is found in "Ultra-Wideband Short-Pulse Electromagnetics," (ed. H. Bertoni, L. Carin, and L. Felsen), Plenum Press New York, 1993 (ISBN 0-306-44530-1).

As recognized by the present inventor, none of the above UWB antennas, however, provide high performance, non-dispersive characteristics in a cost-effective manner. That is, these antennas are expensive to manufacture and mass produce. The present inventor also has recognized that such conventional antennas do not permit integration of radio transmitting and/or receiving circuitry (e.g., switches, amplifiers, mixers, etc.), thereby causing losses and system ringing (as further described below).

Ultra wide bandwidth is a term of art applied to systems that occupy a bandwidth that is approximately equal to their center frequency (e.g., the bandwidth between the −10 dB points is 50% to 200%). A non-dispersive antenna (or general circuit) has a transfer function such that the derivative of phase with respect to frequency is a constant (i.e., it does not change versus frequency). In practice, this means that a received impulse E-field waveform is presented at the antenna's output terminals as an impulse waveform, in contrast to a waveform that is spread in time because the phase of its Fourier components are allowed to be arbitrary (even though the power spectrum is maintained). Such antennas are useful in all radio frequency (RF) systems. Non-dispersive antennas have particular application in radio and radar systems that require high spatial resolution, and more particularly to those that cannot afford the costs associated with adding inverse filtering components to mitigate the dispersive phase distortion.

Another common problem as presently recognized by the inventor, is that most UWB antennas require baluns because their feed is balanced (i.e., differential). These baluns entail additional manufacturing cost to overcome, and cause poor performance. For example, the symmetry of the radiation pattern (e.g., azmuthal symmetry on a horizontally polarized antenna) associated with balanced antennas can be poor because of feed imbalances arising from imperfect baluns. Due to the limited response of ferrite materials, the balun, instead of the antenna, can limit the antenna system bandwidth. Inductive baluns, for example, are traditionally used and are both expensive, and bandwidth limiting.

Another problem with traditional UWB antennas is that it is difficult to control system ringing. Ringing is caused by energy flowing and bouncing back and forth in the transmission line that connects the antenna to the transmitter or receiver—like an echo. From a practical standpoint, this ringing problem is always present because the antenna impedance, and the transceiver impedance are never perfectly matched with the transmission line impedance. As a result, energy traveling either direction on the transmission line is partially reflected at the ends of the transmission line. The resulting back-and-forth echoes thereby degrade the performance of UWB systems. That is, a series of clean pulses of received energy that would otherwise be clearly received can become distorted as the signal is buried in a myriad of echoes. Ringing is particularly problematic when echoes from a high power transmitter obliterate the microwatt signals that must be received in radar and communication systems. The duration of the ringing is proportional to the product of the length of the transmission line, the reflection coefficient at the antenna, and the reflection coefficient at the transceiver. In addition to distortion caused by ringing, transmission lines can be dispersive, and always attenuate higher frequencies more than lower frequencies, causing distortion and stretching of the pulses flowing through the transmission line.

SUMMARY OF THE INVENTION

In view of the foregoing, there still exists a need in the art for a simple UWB antenna that can permits integration of electronics.

It is also an object of this invention to provide an all electronic means of generating and receiving balanced signals without costly, bandwidth limiting inductive baluns.

Another object of the present invention is to build array antennas with unique properties because each array element is separately powered (i.e., the ground and power for the active electronics circuit of each array element is decoupled from the other elements).

It is also an object of this invention to provide a novel apparatus and system for providing a UWB antenna that is inexpensive to mass-produce.

It is also an object of this invention to provide a novel apparatus and system for providing a UWB antenna that has a flat magnitude response and flat phase response over ultra wide bandwidths.

It is also an object of this invention to provide a novel apparatus and system for providing a UWB antenna that exhibits a symmetric radiation pattern.

It is also an object of this invention to provide a novel apparatus and system for providing a UWB antenna that is efficient, yet electrically small.

It is also an object of this invention to provide a novel apparatus and system for providing a UWB antenna that integrates transmission and reception circuits on the same substrate.

It is also an object of this invention to provide a novel apparatus and system for providing a UWB antenna that is planer and conformal, so as to be capable of being easily attached to many objects.

It is a further object of this invention to provide a novel apparatus and system for providing a UWB antenna that can be arrayed in 1D (dimension), in which the array of UWB antennas are built on single substrate with the radiation directed in the plane of the substrate.

According to another aspect of the invention, an antenna device having Ultra Wide Bandwidth (UWB) characteristics comprises a first balance element coupled to a terminal at one end. A second balance element is coupled to another terminal at one end, the second balance element having a shape mirroring a shape of the first balance element to provide a symmetry plane between the first balance element and the second balance element, wherein each of the balance elements is made of a generally conductive material. A ground element is situated between the first balance element and the second balance element with an axis of symmetry on the symmetry plane. The above arrangement advantageously provides an UWB antenna that permits the placement of electronics within the antenna.

According to another aspect of the invention, an Ultra Wide Bandwidth (UWB) antenna system comprises a plurality of antenna elements. Each of the plurality of antenna elements includes a first balance element that is coupled to a terminal at one end, and a second balance element that is coupled to another terminal at one end. The second balance element has a shape that mirrors the shape of the first balance element, wherein each of the balance elements is made of a generally conductive material. Each of the antenna elements also includes a ground element that is situated between the first balance element and the second balance element. A timed splitter/combiner circuit is coupled to the plurality of antennas and is configured to steer a beam associated with the plurality of antennas. The above arrangement advantageously provides flexibility in the design of the antenna system, while maintaining cost-effectiveness.

According to yet another aspect of the invention, a method is provided for transmitting signals over an Ultra Wide Bandwidth (UWB) frequency spectrum. The method includes receiving an input source signal at a transmitter. The method also includes radiating a transmission signal at a plurality of terminals in response to the source signal using a UWB antenna. The UWB antenna includes a plurality of balance elements and a ground element that is disposed between the plurality of elements. The balance elements are coupled to terminals. The ground element houses the transmitter. One of the plurality of ground elements has a shape that mirrors another one of the plurality of ground elements. Each of the balance elements is made of a generally conductive material. Under this approach, a cost effective UWB antenna exhibits high performance.

According to yet another aspect of the invention, a method is provided for receiving signals over an Ultra Wide Bandwidth (UWB) frequency spectrum. The method includes a step of receiving the signals via a UWB antenna. The UWB antenna includes a plurality of balance elements and a ground element that is disposed between the plurality of elements. The balance elements are coupled to terminals. The ground element houses the transmitter. One of the plurality of ground elements has a shape that mirrors another one of the plurality of ground elements. Each of the balance elements is made of a generally conductive material. The method also includes outputting a differential signal based upon the receiving step. Under this approach, a UWB antenna provides integration of electronics, thereby minimizing transmission line losses and system ringing.

According to another aspect of the invention, an Ultra Wide Bandwidth (UWB) antenna system comprises a plurality of array elements that are arranged in 1D (dimension). Each of the plurality of array elements includes a first balance element that is coupled to a terminal at one end, and a second balance element that is coupled to another terminal at one end. The second balance element has a shape that mirrors the shape of the first balance element to provide a symmetry plane between the first balance element and the second balance element, wherein each of the balance elements is made of a generally conductive material. Each of the antenna elements also includes a ground element that is situated between the first balance element and the second balance element with an axis of symmetry on the symmetry plane. A timed splitter/combiner circuit is coupled to the plurality of array elements and is configured to control the plurality of array elements. The above arrangement advantageously provides flexibility in the design of the antenna system.

With these and other objects, advantages and features of the invention that may become hereinafter apparent, the nature of the invention may be more clearly understood by reference to the following detailed description of the invention, the appended claims and to the several drawings herein.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
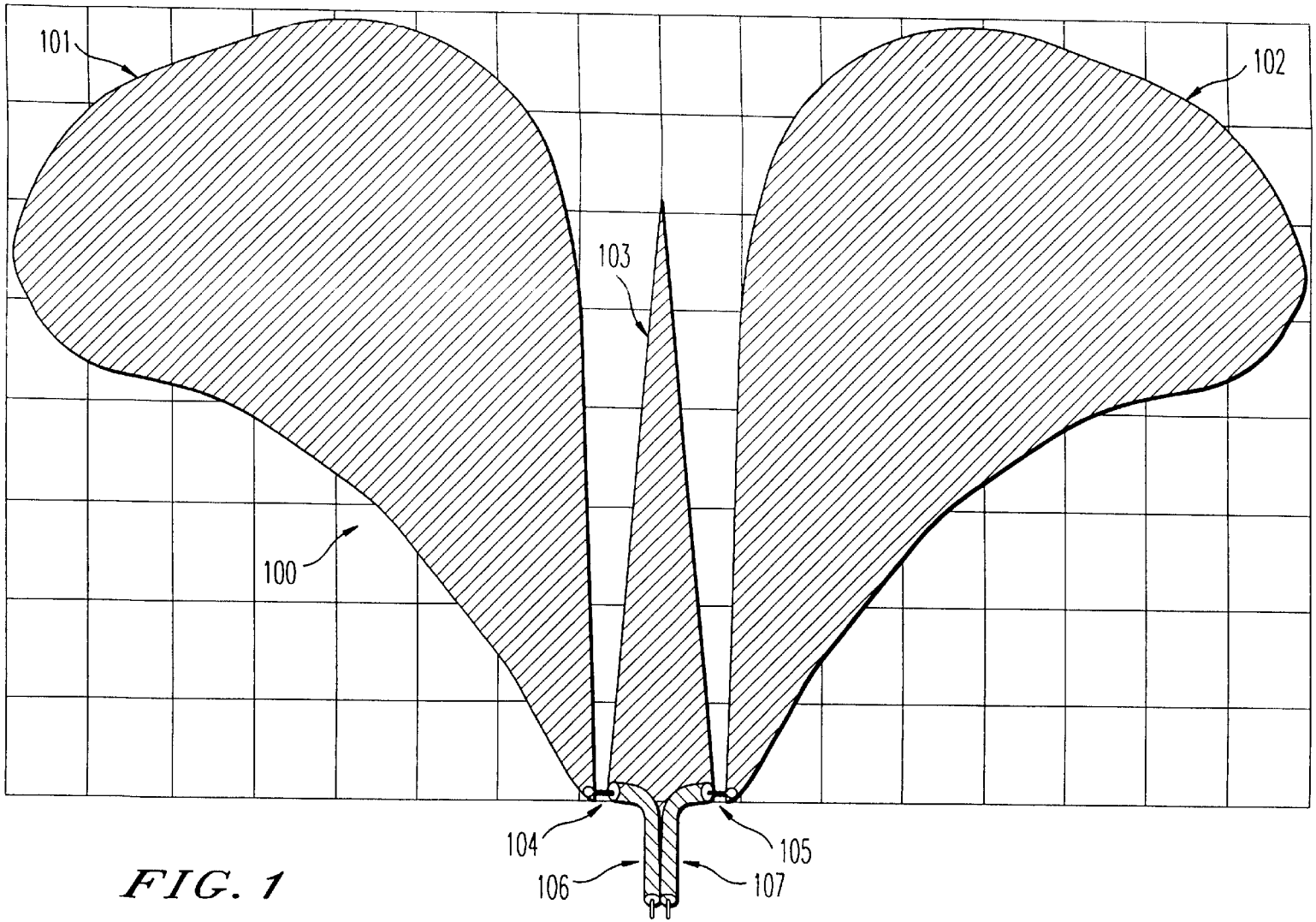
FIG. 1 is a diagram of a UWB antenna that is configured to direct energy out of the top (long) side of a rectangular printed circuit board, according to an embodiment of the present invention.

Referring now to the drawings, specific terminology will be employed for the sake of clarity. However, the present invention is not intended to be limited to the specific terminology so selected and it is to be understood that each of the elements referred to in the specification are intended to include all technical equivalents that operate in a similar manner.

FIG. 1 shows a diagram of a UWB antenna, according to one embodiment of the present invention. The UWB antenna 100 includes balance elements 101 and 102, and a ground element 103 that is situated between the two balance elements 101 and 102. The elements 101–103 are made of a generally conductive material (e.g., copper); that is, the material may be a resistive metal. Each of the balance elements 101 and 102 is connected to terminals 104 and 105, respectively, at the bottom end of the antenna 100. The terminals 104 and 105 attach a differential signal either to or from the antenna 100. The shape of balance element 101 increases in width from the point of connection of terminal 104 and is rounded at the top end. The other balance element 102 has a shape that mirrors that of balance element 101 such that there is a symmetry plane where any point on the symmetry plane is equidistant to all mirror points on the first and second balance elements. The ground element 103 has a generally triangular shape with an axis of symmetry on the symmetry plane, which is oriented such that the base of the triangle is towards the terminals 104 and 105. Accordingly, the ground element 103 and each of the balance elements 101 and 102 forms two tapered gaps; the taper extends outwardly from the terminals 104 and 105.

In an exemplary embodiment, the antenna 100 employs standard coaxial cables 106 and 107 to connect to the terminals 104 and 105. The operating characteristics of the antenna 100 depend largely on the relative configurations of the balance elements 101 and 102 and the shape of the ground element 103. In this example, the tapered gaps between the ground element 103 and the balance elements 101 and 102 determine the response of the antenna 100. The tapered gaps exist to provide a smooth impedance transition. That is, the shape of the balanced elements 101 and 102 coupled with the tapered gaps produce a traveling wave along a transmission line with a smoothly growing impedance. The shapes of balance elements 101 and 102, coupled with the gap between the elements, are optimized to provide a smooth impedance transition as measured on a Time Domain Reflectometer (TDR), for any desired long-side to short-side ratio of the rectangular area. The shapes of balance elements 101 and 102 in the preferred embodiment are shown in the square grid in FIG. 1. For narrower bandwidth applications, the optimization can also be done in the frequency domain with a Vector Network Analyzer (VNA) to minimize the reflections over a specific band of frequencies.

In operation, a negative step voltage is applied to balance element 101 via coaxial line 106, while a positive step voltage is applied to balance element 102 through coaxial line 107, resulting in a balanced field where the aforementioned symmetry plane is at ground potential and therefore called a ground symmetry plane. As configured, the antenna 100 provides a ground symmetry plane that is perpendicular to the plane, which contains the elements 101–103.

The dimensions of antenna 100 are such that the width from the outside edge of balance element 101 to the other edge of balance element 102 is greater than the height of the antenna 100, as measured from the bottom ends of the balance elements 101 and 102 to the top ends. In a exemplary embodiment, antenna 100 is formed on a rectangular printed circuit board (not shown). The energy of antenna 100 is directed out the top (long-side) of the rectangular PC board, opposite the terminals 104 and 105.

Figure 2:
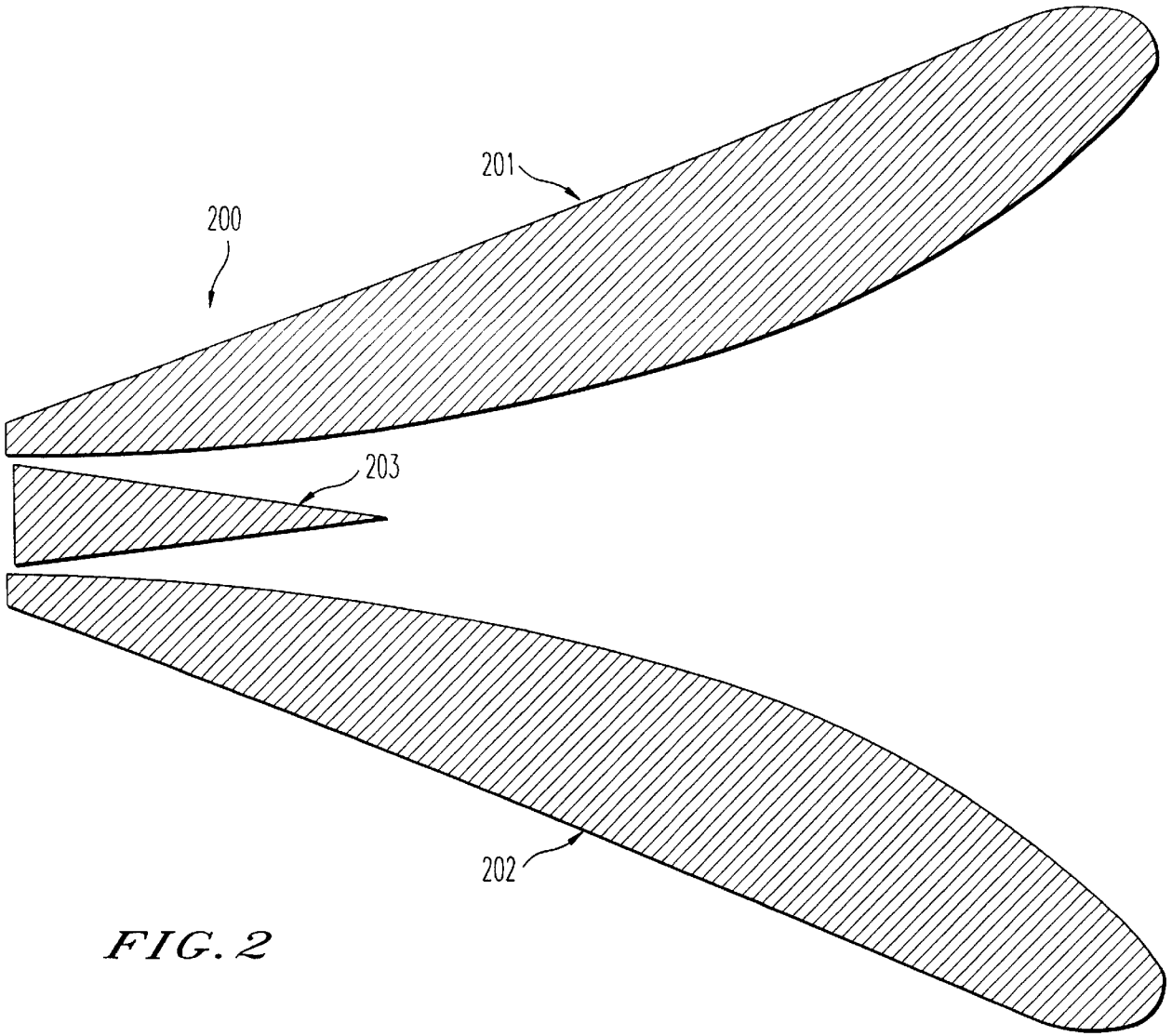
FIG. 2 is diagram of a UWB antenna that is configured to direct energy out of the right (short) side of a rectangular printed circuit board, according to an embodiment of the present invention.

FIG. 2 shows a UWB antenna with elongated balance elements, in accordance to an embodiment of the present invention. Antenna 200, similar to the construction of antenna 100 of FIG. 1, has two balance elements 201 and 202 with a ground element 203 disposed between such elements 201 and 202. Unlike the antenna 100 of FIG. 1, the balance elements 201 and 202 are considerably longer than the ground element 203 and exhibit widths are do not vary as dramatically. In an exemplary embodiment, antenna 200 is optimized to direct energy out of the right (short) side of a rectangular PC board (not shown). Although not labeled, antenna 200 includes two feed points, similar to that of antenna 100 (FIG. 1).

Figure 3:
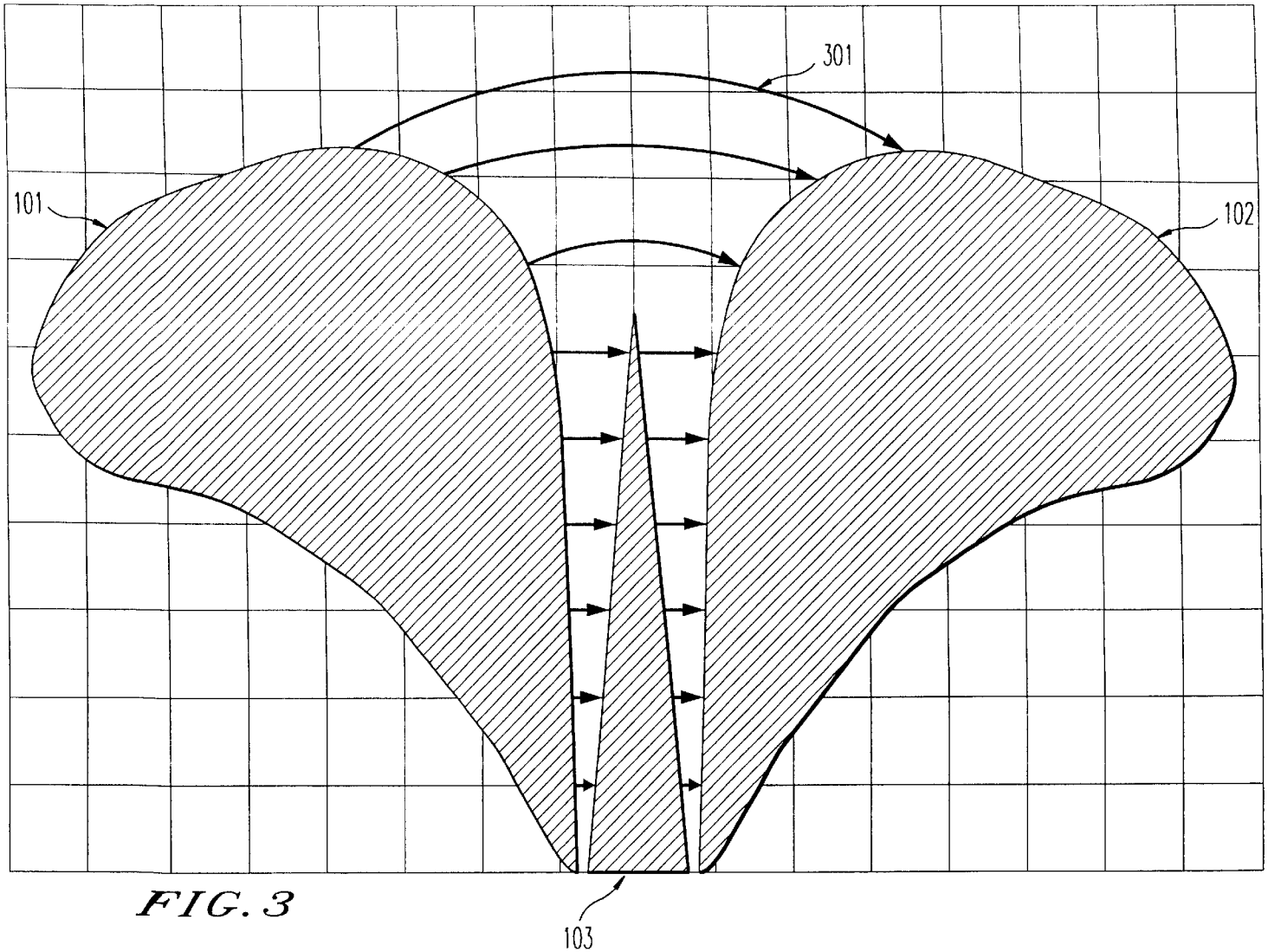
FIG. 3 is a diagram of the electromagnetic fields propagating along the length of the UWB antenna of FIG. 1.

FIG. 3 shows the manner in which the electromagnetic fields propagate along the length of the antenna of FIG. 1. As mentioned above, at the apex and axis of ground element 103 is on the ground symmetry plane, which is equidistant to the opposing fields on the balance elements 101 and 102. Turning back to FIG. 1, the antenna 100 possesses two feeds (i.e., terminals 104 and 105). There is a feed 104 between the ground and the first balance element 101, as well as a feed 105 between ground and the second balance element 102.

As shown, the field 301 propagates out from the feed points 104 and 105 from balance element 101 to balance element 102. The arrowheads denote positive; thus, given the excitation, as discussed in FIG. 1, the field 301 propagates out from the driven point 104 and from the driven point 105 towards the apex of the triangular ground element 103. Beyond the ground element 103, the field 301 exists without the intervention of the ground element 103, and continues, radiating out into space.

The ground element 103 permits the increased separation between the first and second balance elements 101 and 102, thereby reducing the low frequency cut-off point of the antenna 100. In other words, the balance elements 101 and 102 can be placed further apart from each other, relative to the case with no intervening ground element 103. The low frequency cut-off point of the antenna 100 depends on the dimensions of the antenna 100. The ground element 103, essentially, spreads the balance elements 101 and 102 to yield a larger radiation area, but more importantly, splits the gap where the fields are contained almost entirely within the gap.

As a result of the ability to split the gap, the ground symmetry plane is effectively pulled apart in a small area near the feed locations 104 and 105. Accordingly, the antenna 100 can advantageously integrate electronics packages at these two feed points 104 and 105. For example, transmitting or receiving amplifiers can be mounted within the antenna structure 100 itself. This capability addresses the problems associated with the use of intervening baluns and cables running to the amplifiers. Consequently, a high performance, high bandwidth antenna can be obtained economically. This concept of integrating electronics into the antenna 100 is shown in FIG. 4.

Figure 4:
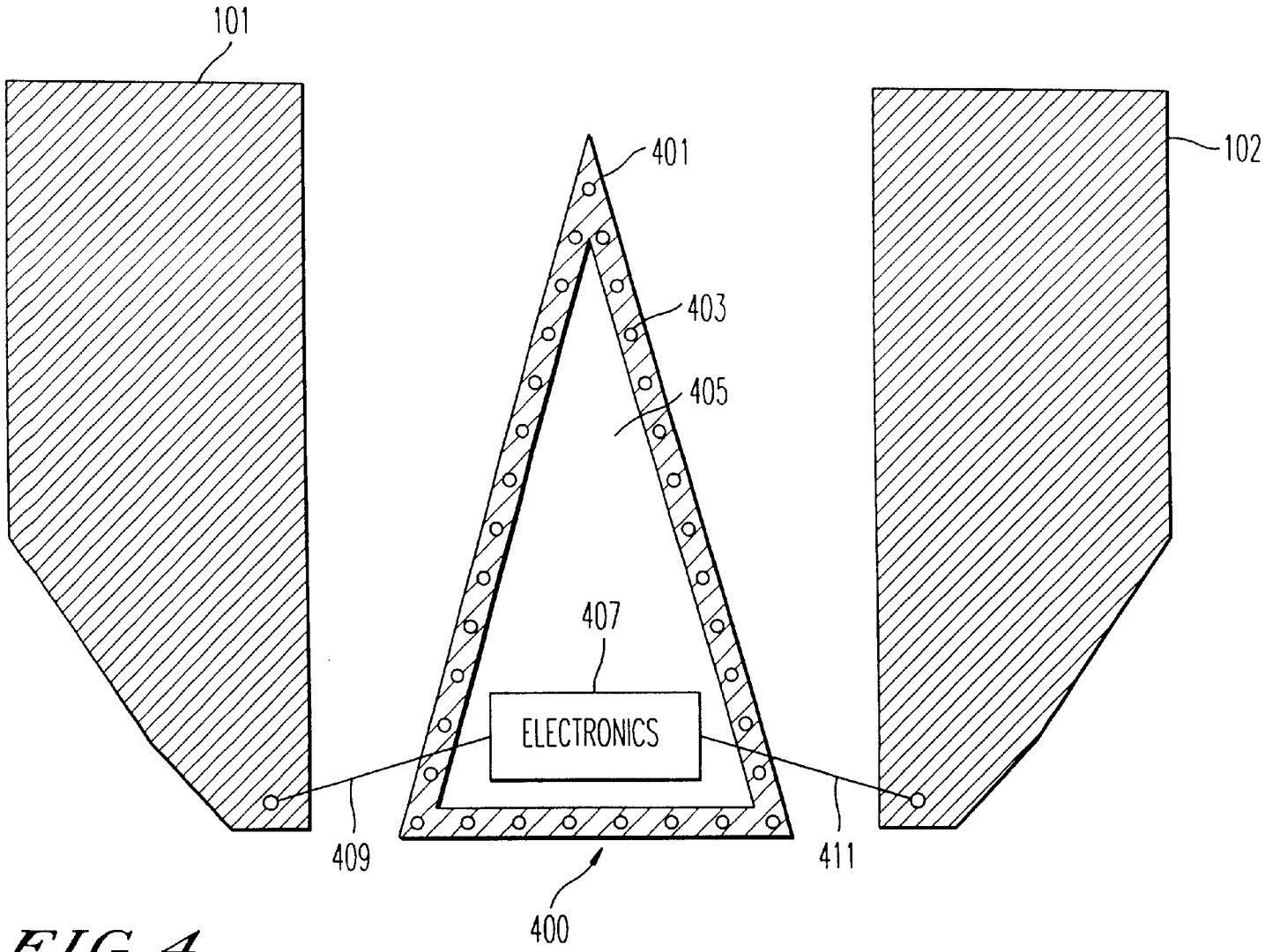
FIG. 4 is a diagram of an exploded view of the ground element of a UWB antenna in which electronics are integrated into the antenna, in accordance with an embodiment of the present invention.
Figure 6A:
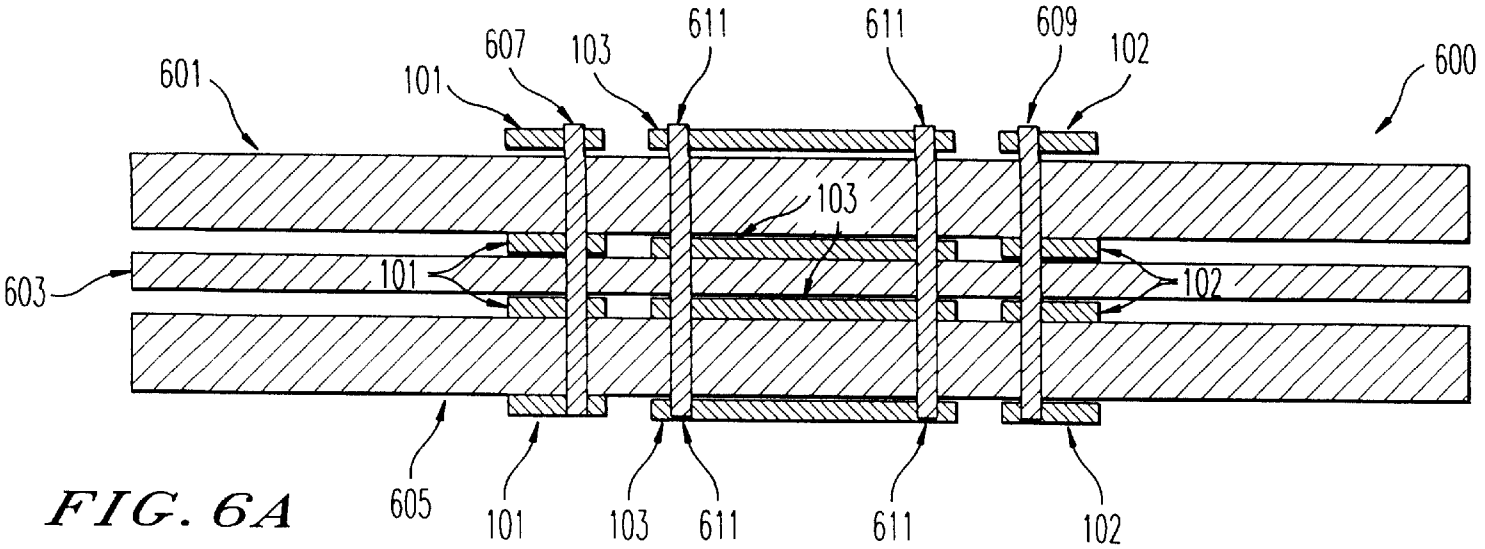
FIGS. 6A–6D are diagrams of various exemplary embodiments of the present invention involving different layering configurations of the UWB antenna.
Figure 6B:
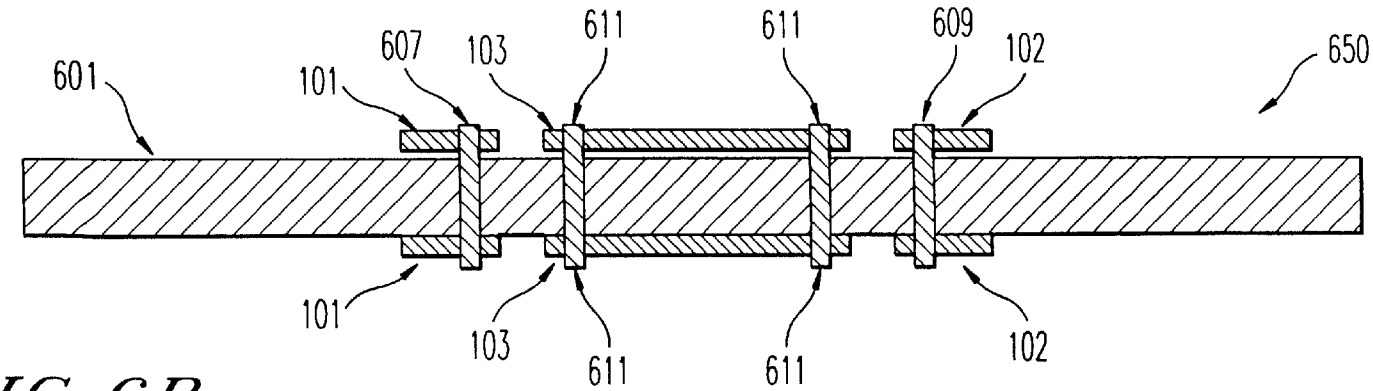

FIG. 4 shows an exploded view of a ground element with integrated electronics, according to an embodiment of the present invention. Ground element 401 includes vias 403 that can connect the ground element 401 to ground planes (not shown), which are on the opposite side of the antenna 400. In addition, vias 403 can connect the inner layers of a multi-layer embodiment (as shown in FIGS. 6A and 6B). In contrast to the ground element 103 of antenna 100 (FIG. 1), ground element 401 has a cutout area 405. Within the cutout area 405, various electronics 407 can be placed. For example, a network, such as broadband amplifiers or switches or mixers, may reside within the ground element 401. The electronics 407 connects to the balance elements 101 and 102, through lead lines 409 and 411, respectively. It should be noted that FIG. 4 provides only a partial illustration of balance elements 101 and 102, which are completely illustrated in FIG. 1. Electronics 407 can occupy the cutout area 405 within the triangular ground element 401, because the antenna fields exist primarily in the gaps between elements 101 and 401 and between elements 102 and 401, but not within the ground element 401 itself.

Ground element 103, can be formed with a single sheet of metal (e.g., copper) or a generally conductive material, such that only the perimeter serves as ground, as shown on ground element 401. Accordingly, the fields now exist between the balance element 101 and the ground element 401, wherein the perimeter of the ground element 401 establishes the location of the fields. Thus, the impedance of the antenna 400 is essentially identical to that of the antenna 100 of FIG. 1, which utilizes a ground element without a cutout area.

The above approach advantageously achieves performance and packaging improvements by providing the capability to integrate sensitive electronics 407 (e.g., UWB receiver amplifiers and/or transmitter amplifiers) within the antenna 400. In particular, amplifiers, for example, can connect directly to the antenna terminals, thereby eliminating transmission line losses, dispersion, and ringing associated with conventional UWB antennas.

Figure 5A:
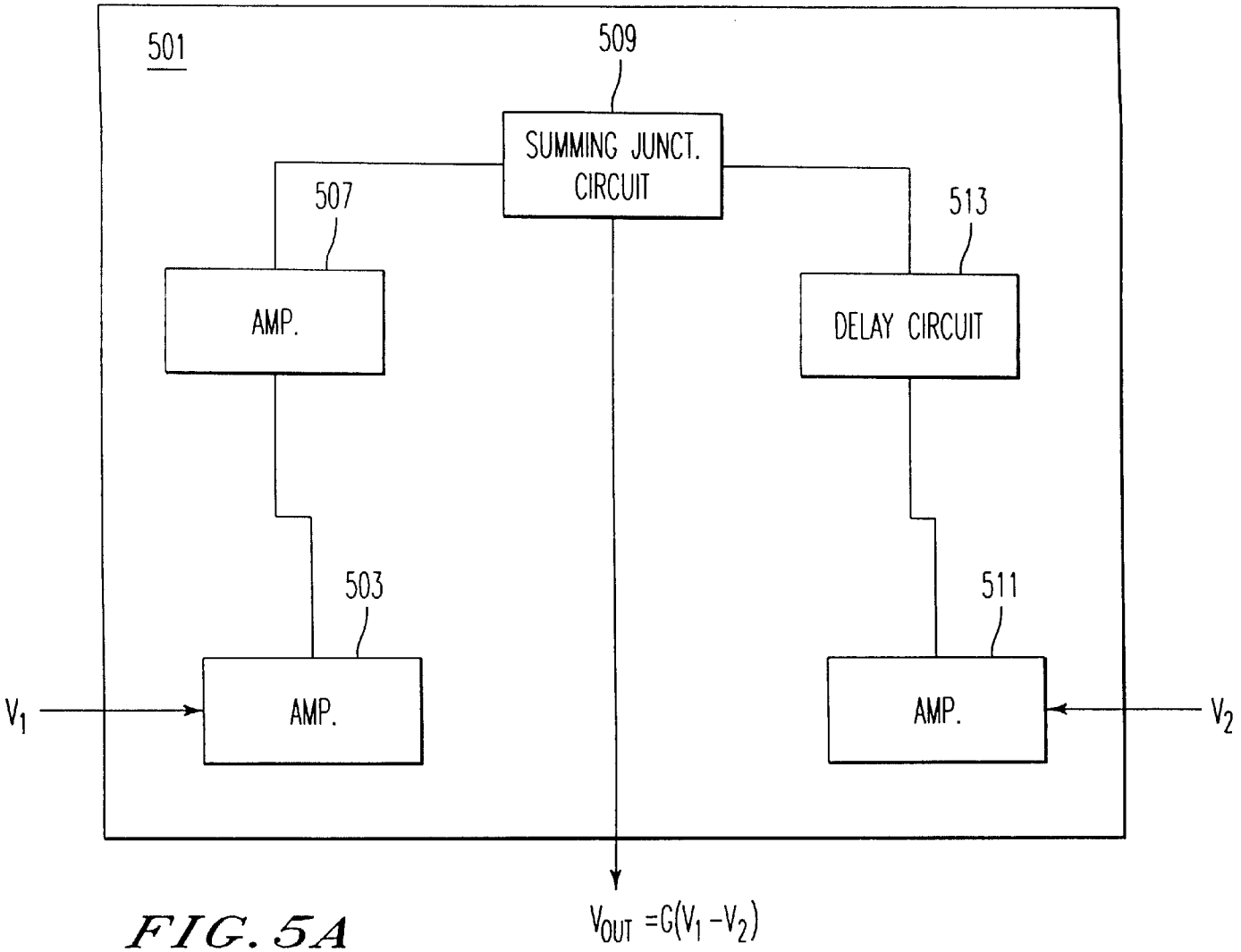
FIGS. 5A and 5B are diagrams of a receiver circuit and a transmitter circuit, respectively, that may be placed in the UWB antenna of FIG. 4.
Figure 5B:
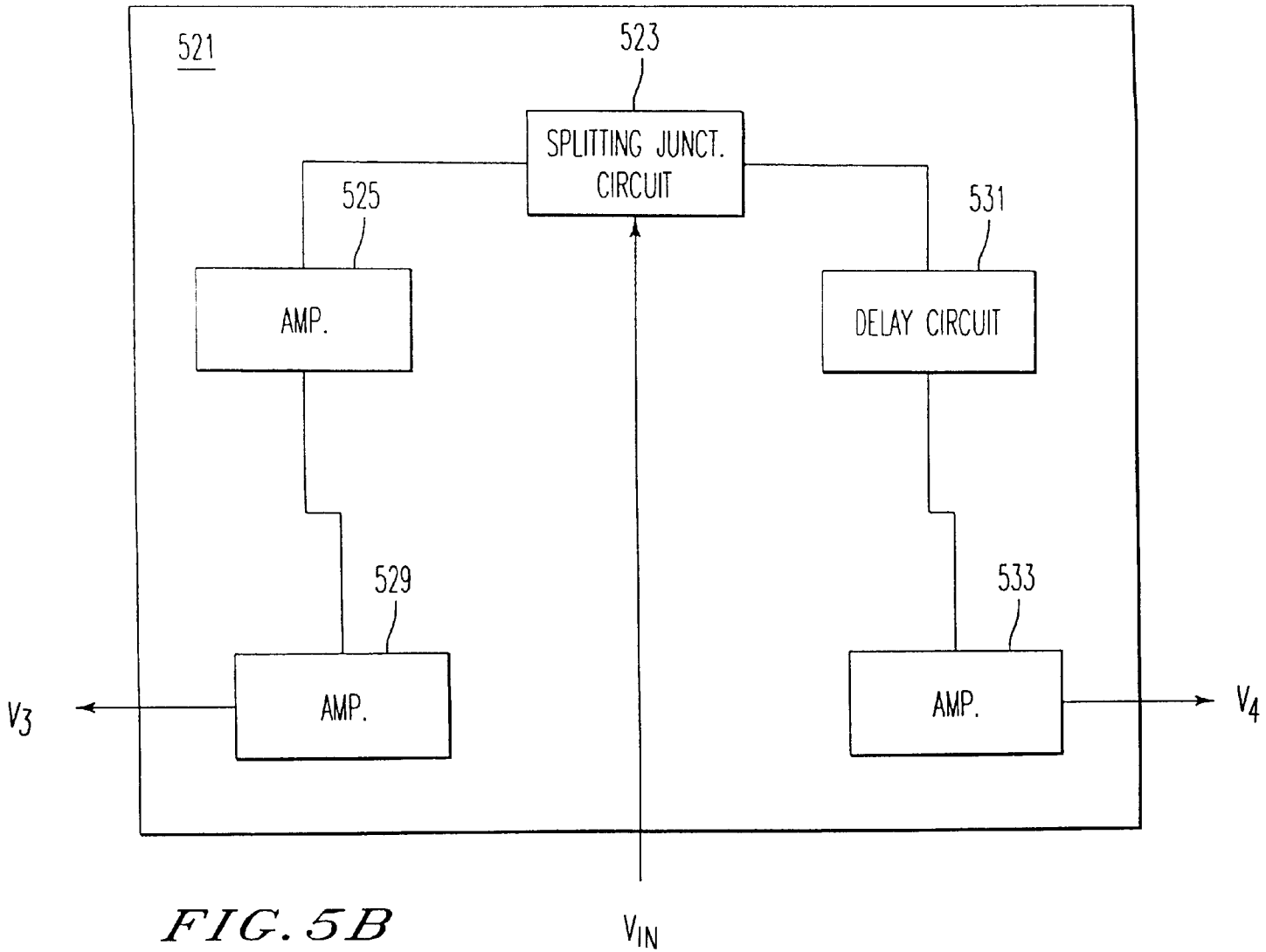

FIGS. 5A and 5B show block diagrams of a receiver and a transmitter, respectively, which reside within the ground element of the UWB antenna, according to an embodiment of the present invention. In FIG. 5A, a receiver 501 includes a microwave amplifier 503, which receives an input signal ($V_1$) from the terminal of a balance element 101 (FIG. 4). The amplifier 503 is connected to amplifier 507. Amplifier 507 receives the signal from amplifier 503 and outputs to a summing junction circuit 509.

The receiver 501 also has an amplifier 511 that is connected to the terminal of the second balance element 102 (FIG. 4). The balance element 102 supplies a signal ($V_2$) to the input of amplifier 511. Each of the amplifiers 503, 507, and 511 are microwave amplifiers; as such, these amplifiers 503, 507, and 511 invert the input signals. To compensate for the phase inversions, utilizing an odd number of amplifiers to one of the balanced elements (e.g, balance element 101), and an even number of amplifiers to the other balanced element (e.g., balance element 102) creates a balanced antenna system, assuming the differential phase shift through both paths is 180 degrees at all frequencies, and the amplitudes are matched. For example, the receiver 501 may use Mini-Circuits ERA-5SM amplifiers; these amplifiers are within +/−2 degrees from 1 MHZ to 4 GHz.

The amplifier 511 receives an input signal through the balance element 102 and outputs the signal to a delay circuit 513. The delay circuit 513 supplies the signal from amplifier 511 to the summing junction circuit 509 at the same time as the signal from amplifier 507 arrives at the circuit 507. In other words, the delay circuit 513 accounts for the delay associated with amplifier 507 and connection line lengths. The summing junction circuit 509 outputs a voltage, $V_{OUT}$ in response to the received signals, $V_1$ and $V_2$, according to the following equation:

$$V_{OUT}(t)=Gr*[V_1(t-x)-V_2(t-x)],$$

where Gr represents that gain of the receiver 501, t represents time, and x represents the time delay from the input to amplifiers 503 and 511, to the summing junction output.

FIG. 5B shows a transmitter that can be integrated into the ground element of the UWB antenna of FIG. 4. Transmitter 521 has a splitting junction circuit 523 that receives an input signal from a signal source (not shown) and divides the received signal to two paths. The first path of the divided signal is transferred to an amplifier 525, which is connected to amplifier 529. The amplifier 529 outputs the divided signal to the terminal of balance element 101 (FIG. 4). The second path of the divided signal is sent to a delay circuit 531 and then to an amplifier 533, which outputs the signal to the second balance element 102 (FIG. 4). The delay circuit 531 ensures that the signal output from amplifier 533 arrives at the terminal of the second balance element 102 (FIG. 4) at the same time that the corresponding divided signal reaches the terminal of balance element 101. Since the amplifiers are inverting, and the divider adjusts the amplitudes according to the gain along each path, the output voltage $V_3$ of amplifier 529 is equal in amplitude and 180 degrees out of phase with the output voltage $V_4$ of amplifier 533. So in response to an voltage $V_{IN}$ feeding the splitting junction circuit 523, the two output voltages are:

$$V_3(t)=-V_4(t)=Gt*V_{IN}(t-x)$$

where Gt represents that gain of the transmitter 521, t represents time, and x represents the time delay from the input of splitting junction circuit 523 and the outputs of amplifiers 529 and 533.

The present invention advantageously permits the integration of active components, such as receiver 501 and transmitter 521, into the antenna structure. The placement of electronics 407 within the ground element 401 (FIG. 4) minimizes system ringing by matching the amplifier input impedance to the antenna, isolating the antenna impedance from the transmission line impedance with the reverse transfer impedance of the amplifiers, and minimizing the round-trip echo time to that inherent in the transmission line structure of the antenna itself. Further, design flexibility is greatly enhanced, as discussed below with respect to FIGS. 6A and 6B.

FIG. 6A shows a cross-sectional view of a multi-plane (or multi-layer) UWB antenna design, in accordance with an embodiment of the present invention. As seen in FIG. 6A, the UWB antenna system 600 has three substrate layers 601, 603, and 605, which contain the elements 101–103 of the UWB antenna 100 on both surfaces of each of the substrate layers 601, 603, and 605. According to an exemplary embodiment, the substrate layers are PC boards, and the UWB antenna components 101–103 are copper. Each plane of the ground elements 103 can house electronics; thus, the UWB antenna system 600 can be designed such that the electronics are distributed among the different planes. For example, the ground element 103 on top of layer 601 can be designated to contain a receiver 501 (FIG. 5A), while the ground element 103 on the bottom of layer 605 can house a transmitter 521 (FIG. 5B). Alternatively, ground elements 103 on the surfaces of layer 603 may possess components that are common to both the receiver 501 and the transmitter 521; the common component, for instance, may be the delay circuit (e.g., 513, and 531). In actual implementation, the delay circuit is made of a transmission line; thus, in the UWB antenna system 600, this delay circuit can be a stripline or microstrip line on layer 603. In an exemplary embodiment, one plane of the ground element 103 on layer 603 can be configured to house a power source, in which the other plane of ground element 103 serves as a ground plane. Vias 607 and 609 connect the multiple planes of balance element 101 and balance element 102, respectively. The multiple planes of ground elements 103 are connected through vias 611. Under the above arrangement, it is recognized that the UWB antenna system 600 can be designed with any number of layers to integrate a large number of electronic components. Importantly, the present invention permits multi-layering in a way that reduces the number of these electronic components (e.g., delay circuit), without sacrificing antenna performance. Consequently, T/R (transmitter/receiver) switching can be readily achieved with the fewest number of components in a very small area.

FIG. 6B shows a UWB antenna system with a single substrate layer, according to one embodiment of the present invention. The UWB antenna system 650 essentially is one layer of the multi-layer design of the UWB antenna system 600 of FIG. 6A. Specifically, a substrate layer 601 includes antenna components 101–103 on both surfaces. Vias 611 connects the ground elements 103. Vias 607 and 609 connect the balance elements 101 and 102 respectively. It is clear that the present invention provides significant design flexibility. This capability decreases production costs in that it can reduce the number of discrete components and can by readily adapted to existing manufacturing processes.

Figure 6C:
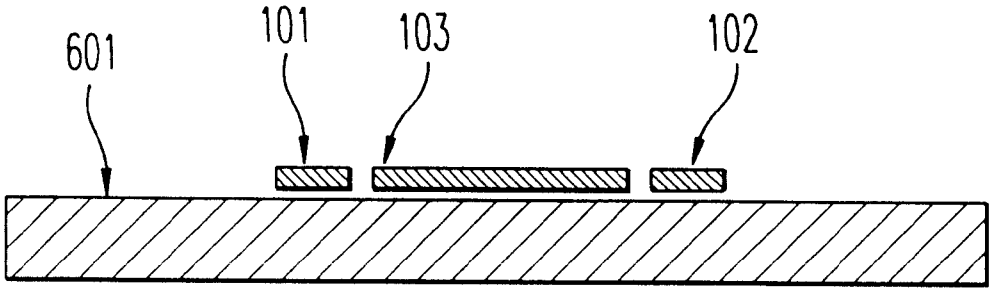
Figure 6D:
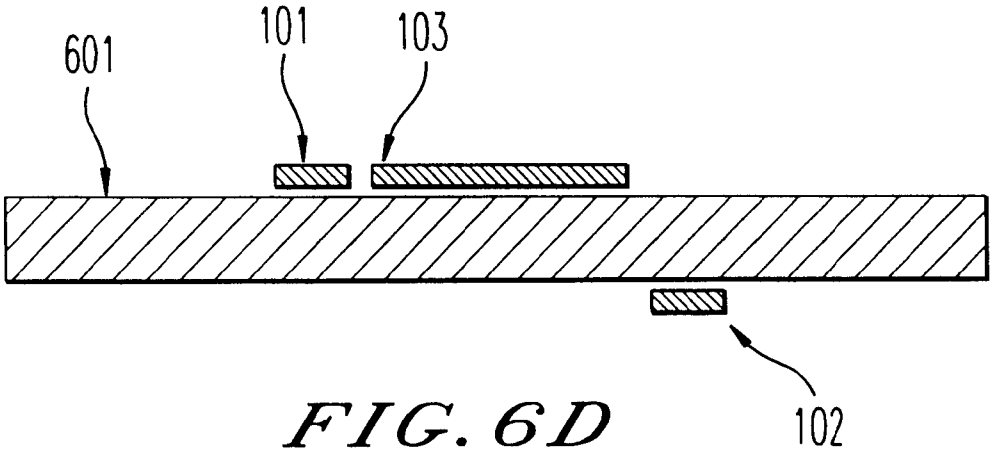

FIG. 6C shows a single-layer UWB antenna design, according to an embodiment of the present invention. The balance elements 101 and 102 as well as the ground element 103 are formed on only one surface of substrate 601. In another embodiment, shown in FIG. 6D, one of the balance elements 102 is formed on the bottom surface of substrate 601. Thus, the present invention offers great flexibility in configuring the UWB antenna, based upon a multitude of conformal design parameters and objectives.

Figure 7:
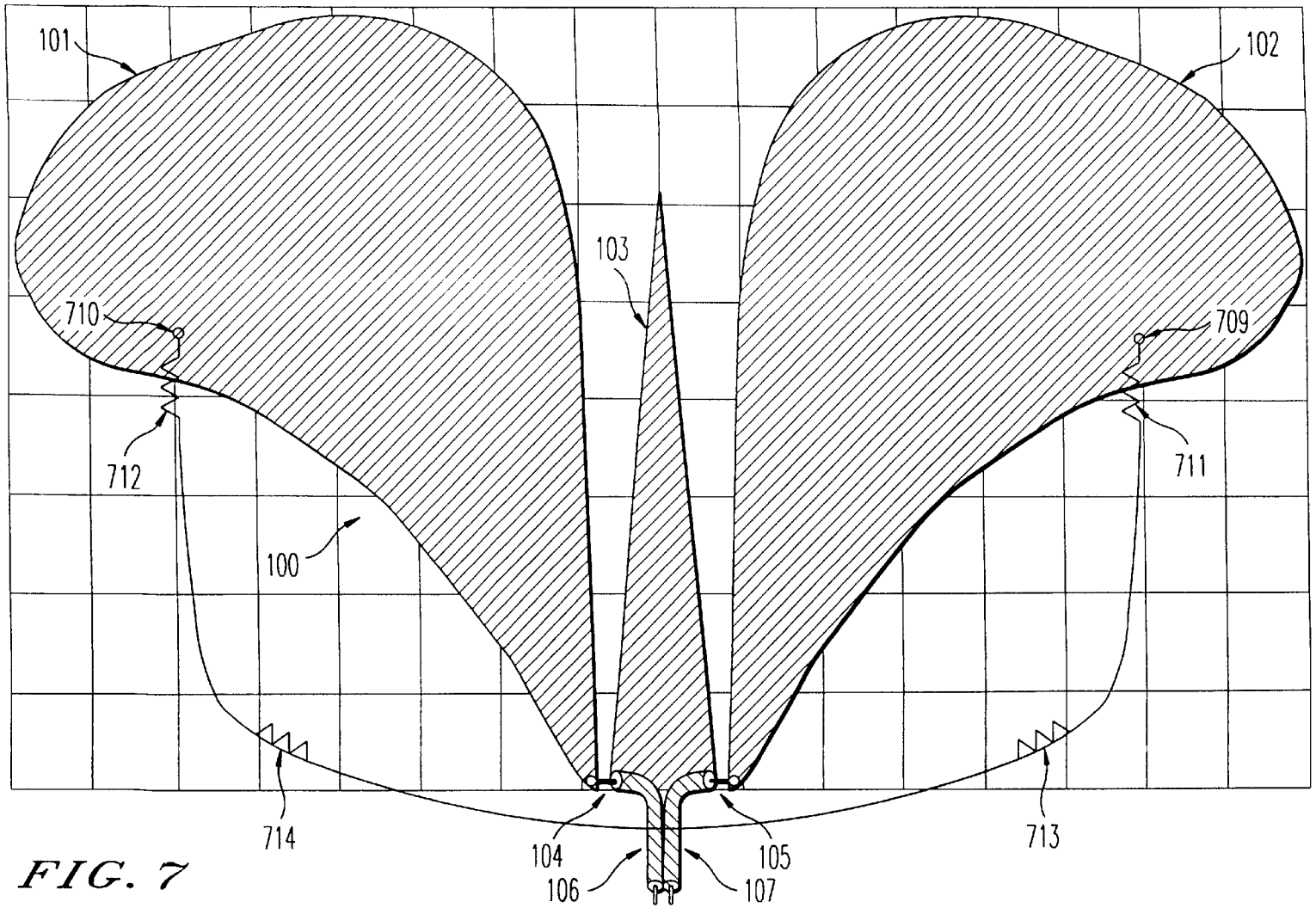
FIG. 7 is a diagram of the UWB antenna of FIG. 1 with a resistive conductive loop connection that provides a low frequency return path, according to an embodiment of the present invention.

FIG. 7 shows a diagram of a UWB antenna of FIG. 1 with a resistive conductive loop connection, according to an embodiment of the present invention. Signal reflections, which are particularly pronounced at low frequencies, can potentially damage sensitive electronics within the antenna 100, in addition to causing system ringing. To minimize this effect, a resistive conduction loop 708 is attached to the antenna 700 to supply a DC path. The resistive conductive loop 708 connects to balance element 101 at point 710 and to balance element 102 at point 709. The resistive conductive loop 708 provides a low frequency return path and can be continuous or lumped at points 711, 712, 713, and 714. For example, a resistive material ,like nichrome or resistive ink, can be employed, thereby providing a continuously resistive loop 708. Alternatively, resistors 712–714 can be attached to the conductive loop 708 to make the loop 708 resistive.

Furthermore, this loop 708 allows the antenna 700 to operate as a loop antenna at low frequencies. In addition, at low frequencies the resistive conductive loop 708 improves the VSWR. The loop 708, as seen in FIG. 7, is situated behind the terminals 104 and 105 so that low frequency energy is directed out of the antenna in the same direction as the high frequencies. It should be noted that antenna response is dictated by the following factors: local of the attachment points 710 and 709 on the balance elements 101 and 102, the length of the loop 708, placement of the loop relative to the terminals 104 and 105 (e.g., in front of, behind, or between the terminals 104 and 105), and the resistance of the loop. With respect to the length of the loop 708, a longer loop exhibits greater low frequency radiation. For smooth impedance transition between lower frequency loop operation and higher frequency traveling wave operation, a shorter loop provides better results.

Figure 8:
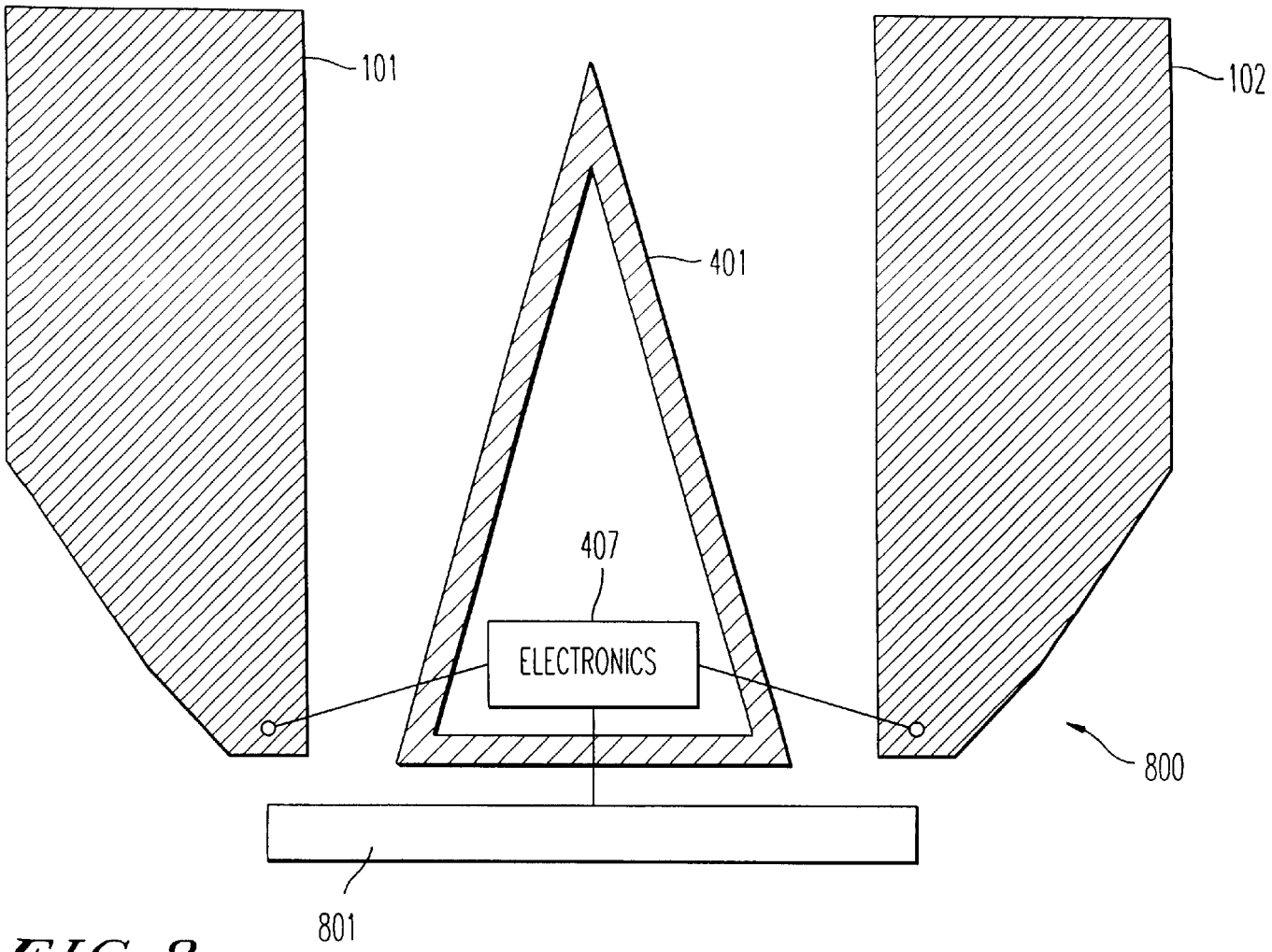
FIG. 8 is diagram of the UWB antenna of FIG. 4 with a short ground (or power bar) that is located behind the antenna, according to an embodiment of the present invention.

FIG. 8 shows a UWB antenna of FIG. 4 that utilizes a short power/ground bar, according to an embodiment of the present invention. For single layer designs, bar 801 provides a convenient power/ground bar for making connections to the electronics 407. The relatively short bar 801 provides little interaction with the fields. Alternatively, the bar 801 can be extended, as in FIG. 9.

Figure 9:
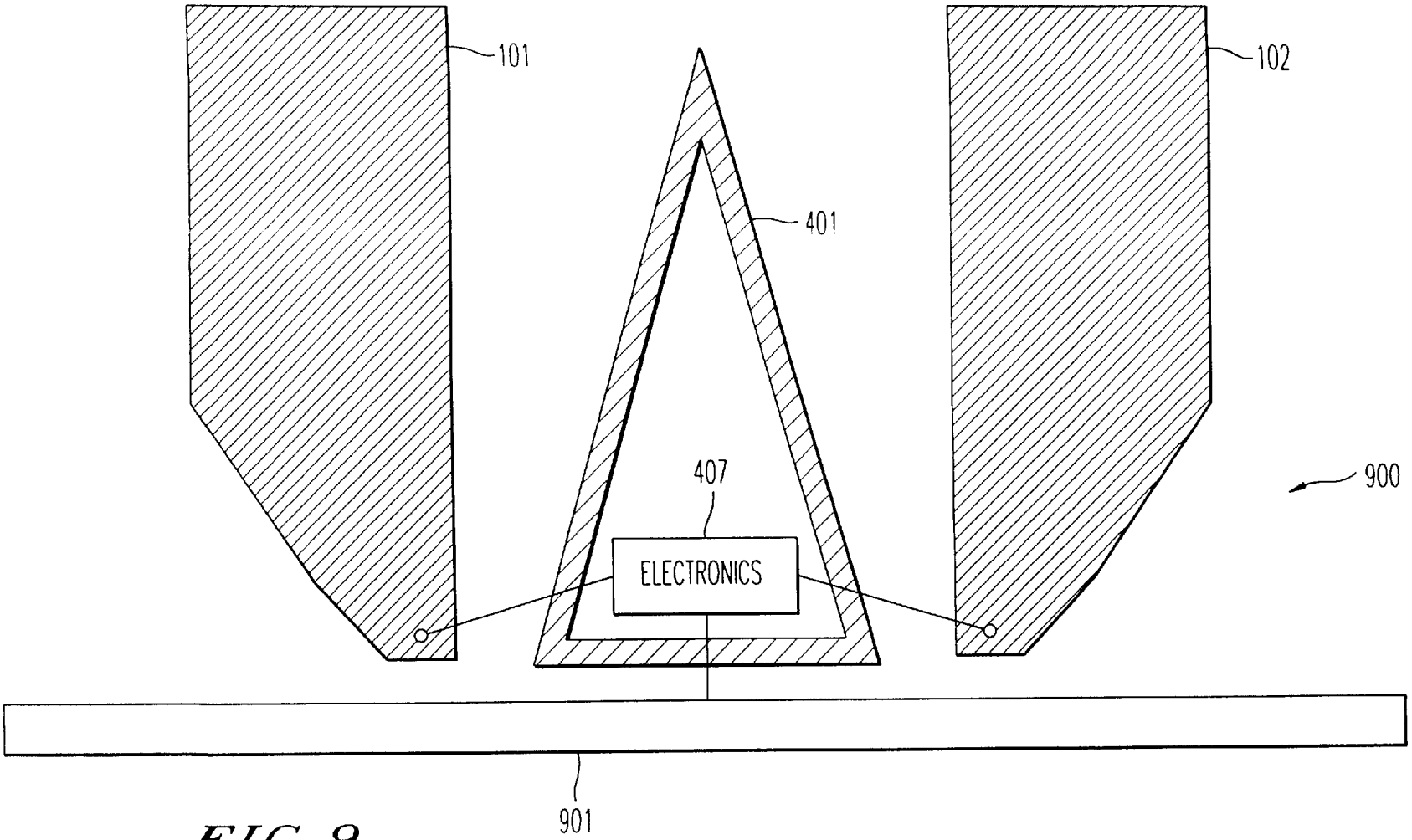
FIG. 9 is diagram of the UWB antenna of FIG. 4 with an extended ground (or power bar) that is located behind the antenna, according to an embodiment of the present invention.

FIG. 9 shows a UWB antenna of FIG. 4 with an extended power/ground bar, according to one embodiment of the present invention. The extended bar 901, as with the bar 801 of FIG. 8, provides connections to the electronics 407. In addition, the extended bar 901 acts as a reflector to yield a different radiation pattern than that of antenna 401. The longer bar 901 can be used to alter the shape of the impulse response as well as the front-to-back ratio of the antenna 900.

Figure 10:
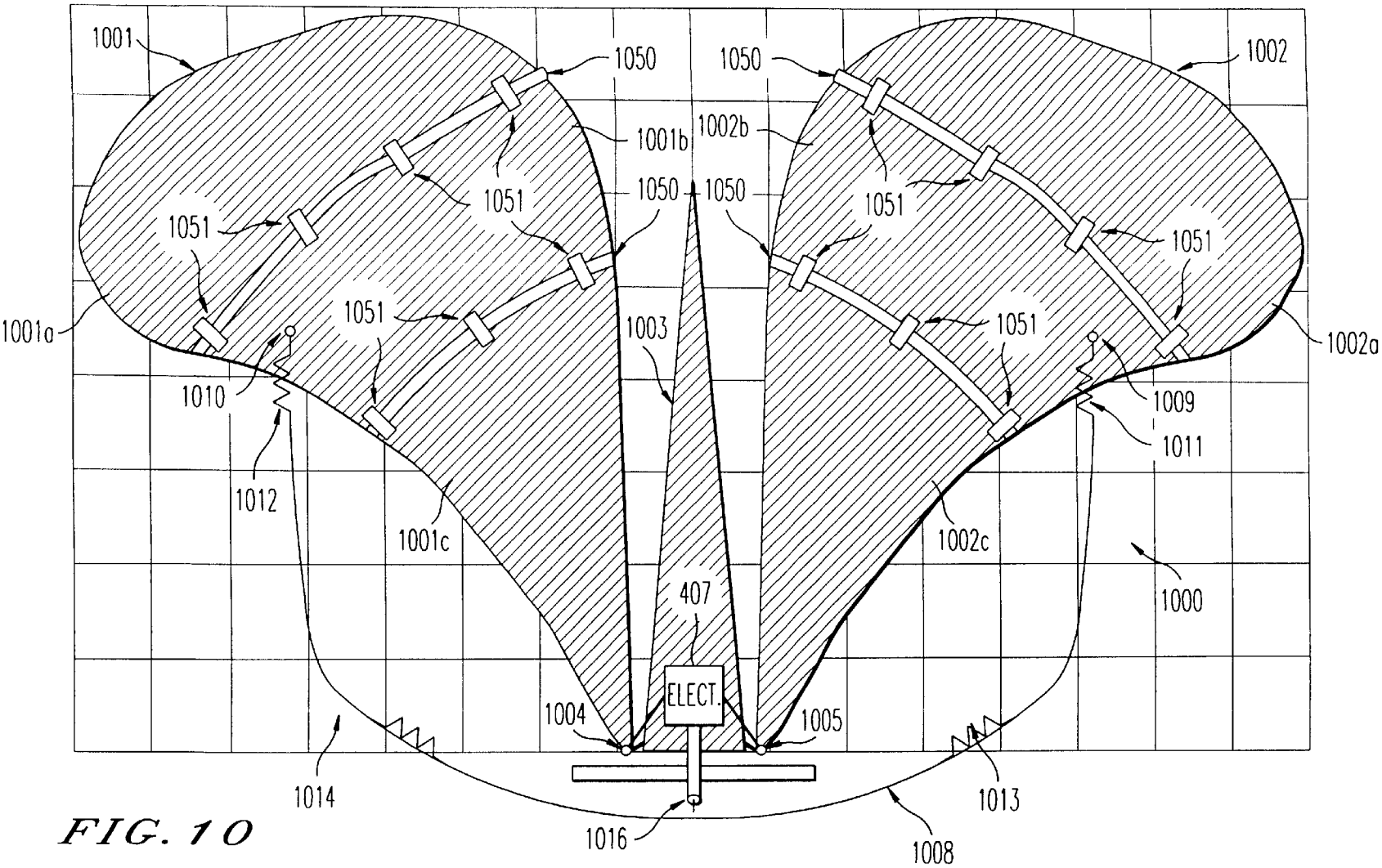
FIG. 10 is a diagram of a UWB antenna with resistive loading as well as a resistive conductive loop, according to an embodiment of the present invention.

FIG. 10 shows a diagram of a UWB antenna in which a resistive load is applied on the balance elements, along with a resistive conductive loop, in accordance with an embodiment of the present invention. Similar to the design of FIG. 1, a UWB antenna 1000 includes two balance elements 1001 and 1002 and a triangular ground element 1003. The shapes of the two balance elements 1001 and 1002 mirror each other; each of the shapes tapering outward from the terminals 1004 and 1005, which are connected to balance element 1001 and balance element 1002, respectively. Each of the balance elements 1001 and 1002 is partitioned into three sections. That is, balance element 1001 has partitions 1001*a*, 1001*b*, and 1001*c*. Similarly, balance element 1002 is partitioned into three sections 1002*a*, 1002b*b*, and 1002*c*. To form a resistive sheet, resistors 1051 join the respective sections of balance elements 1001 and 1002. Resistive loading allows the antenna 1000 to trade efficiency for a reduction in gain ripple and VSWR ripple relative to frequency. To create the partitions, according to one embodiment of the present invention, gaps 1050 are etched into the balance elements 1001 and 1002. The two balanced elements 1001 and 1002 have resistors 1051 that attached across the gaps 1050 to simulate a resistive sheet. Alternatively, a resistive metal sheet or conductive ink can be used for elements 1001 and 1002.

Further, the antenna 1000 employs a resistive conductive loop 1008, which has resistors 1011–1014 and is looped behind terminals 1004 and 1005. These terminals 1004 and 1005 are connected to the electronics 407 within the ground element 1003.

Figure 11:
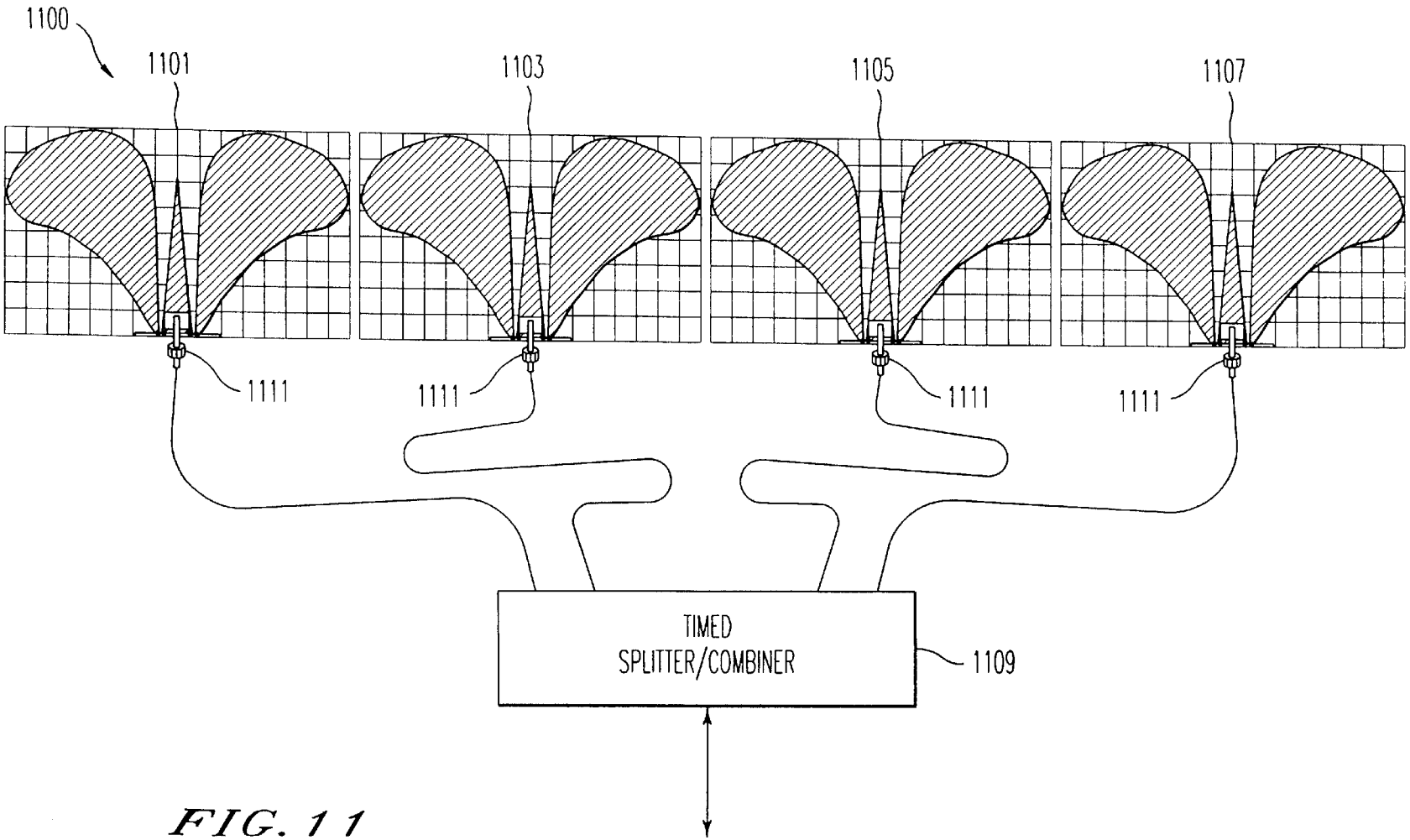
FIG. 11 is a diagram of a 1D array of UWB antennas, according to an embodiment of the present invention.

FIG. 11 shows a diagram of a ID array of UWB antennas, according to an embodiment of the present invention. The UWB antenna array 1 100 can include any number of array elements 1101, 1103, 1105, and 1107, which are connected to a timed splitter/combiner circuit 1109. The timed splitter/combiner circuit 1109 controls the steering of the beam that is associated with the array 1100 by delaying and weighting the signals feeding the array elements 1101, 1103, 1105, and 1107. The ferrite core 1111 in each of the array elements 1101, 1103, 1105, and 1107 provides decoupling of the ground and power for the active electronics. This decoupling allows the low-frequency cutoff to be determined not by the element size, but by the size of the array 1100 in its entirety. The elements 1101, 1103, 1105, and 1107 are allowed to combine in series in the air, but combine in parallel in the splitter/combiner circuit 1109 to provide a steerable array 1100 with greater bandwidth than its elements 1101, 1103, 1105, and 1107.

The techniques described herein provide several advantages over prior approaches to producing a high performance, low cost UWB antenna. The present invention, according to one embodiment, provides a copper pattern with a ground element (i.e., separated copper area) that is near the ground symmetry plane between the balanced radiating structures. This ground element creates a ground symmetry area such that electronics can be situated therein. By integrating the electronics with the antenna structure, performance and packaging improvements are attained. By packing sensitive UWB receiver amplifiers and/or transmitter amplifiers within the ground element, the amplifiers can be connected directly to the antenna terminals. This direct connection eliminates the normal transmission line losses and dispersion, and minimizes system ,ringing.

Obviously, numerous modifications and variations of the present invention are possible in light of the above teachings. It is therefore to be understood that within the scope of the appended claims, the invention may be practiced otherwise than as specifically described herein.

What is claimed is:

1. An antenna device having Ultra Wide Bandwidth (UWB) characteristics, comprising:

a first balance element coupled to a terminal at one end;

a second balance element coupled to another terminal at one end, the second balance element having a shape mirroring a shape of the first balance element to provide a symmetry plane between the first balance element and the second balance element, wherein each of the balance elements is made of a generally conductive material; and a ground element situated between the first balance element and the second balance element with an axis of symmetry on the symmetry plane, wherein the ground element has a cutout area, the device further comprising:

electronics situated within the cutout area.

2. The device of claim 1, further comprising:

at least one of a ground bar and a power bar coupled to the electronics and being situated below the terminals, wherein the ground bar provides a ground and the power bar supplies power.

3. The device of claim 2, wherein the ground bar and the power bar is of a sufficient length to behave as a reflector.

4. The device of claim 1, wherein the electronics comprises at least one of a receiver, a transmitter, an amplifier, a switch, and a balun.

5. An antenna device having Ultra Wide Bandwidth (UWB) characteristics, comprising:

a first balance element coupled to a terminal at one end;

a second balance element coupled to another terminal at one end, the second balance element having a shape mirroring a shape of the first balance element to provide a symmetry plane between the first balance element and the second balance element, wherein each of the balance elements is made of a generally conductive material; and a ground element situated between the first balance element and the second balance element with an axis of symmetry on the symmetry plane, wherein each of the balance elements is partitioned into a plurality of sections, the plurality of sections being connected with resistors.

6. An antenna device having Ultra Wide Bandwidth (UWB) characteristics, comprising:

a first balance element coupled to a terminal at one end;

a second balance element coupled to another terminal at one end, the second balance element having a shape mirroring a shape of the first balance element to provide a symmetry plane between the first balance element and the second balance element, wherein each of the balance elements is made of a generally conductive material;

a ground element situated between the first balance element and the second balance element with an axis of symmetry on the symmetry plane; and a conductive loop connected to the first balance element and the second balance element.

7. An antenna device having Ultra Wide Bandwidth (UWB) characteristics, comprising:

a first balance element coupled to a terminal at one end;

a second balance element coupled to another terminal at one end, the second balance element having a shape mirroring a shape of the first balance element to provide a symmetry plane between the first balance element and the second balance element, wherein each of the balance elements is made of a generally conductive material;

a ground element situated between the first balance element and the second balance element with an axis of symmetry on the symmetry plane; and a conductive loop connected to the first balance element and the second balance element, wherein a middle section of the conductive loop is situated behind one end of the ground element.

8. An Ultra Wide Bandwidth (UWB) antenna system comprising:

a plurality of antennas, each of the antennas comprising, a first balance element coupled to a terminal at one end, a second balance element coupled to another terminal at one end, the second balance element having a shape mirroring a shape of the first balance element, wherein each of the balance elements is made of a generally conductive material, and a ground element situated between the first balance element and the second balance element; and a timed splitter/combiner circuit coupled to the plurality of antennas and configured to steer a beam associated with the plurality of antennas, wherein the ground element of one of the plurality of antennas has a cutout area, the system further comprising:

electronics situated within the cutout area of the one antenna.

9. The system of claim 8, wherein the electronics comprises at least one of a receiver, a transmitter, an amplifier, a switch, and a balun.

10. An Ultra Wide Bandwidth (UWB) antenna system comprising:

a plurality of antennas, each of the antennas comprising, a first balance element coupled to a terminal at one end, a second balance element coupled to another terminal at one end, the second balance element having a shape mirroring a shape of the first balance element, wherein each of the balance elements is made of a generally conductive material, and a ground element situated between the first balance element and the second balance element; and a timed splitter/combiner circuit coupled to the plurality of antennas and configured to steer a beam associated with the plurality of antennas, wherein each of the balance elements are partitioned into a plurality of sections, the plurality of sections being connected with resistors.

11. An Ultra Wide Bandwidth (UWB) antenna system comprising:

a plurality of antennas, each of the antennas comprising, a first balance element coupled to a terminal at one end, a second balance element coupled to another terminal at one end, the second balance element having a shape mirroring a shape of the first balance element, wherein each of the balance elements is made of a generally conductive material, and a ground element situated between the first balance element and the second balance element; and a timed splitter/combiner circuit coupled to the plurality of antennas and configured to steer a beam associated with the plurality of antennas, wherein one of the antennas further comprises:

a conductive loop connected to the first balance element and the second balance element.

12. An Ultra Wide Bandwidth (UWB) antenna system comprising:

a plurality of antennas, each of the antennas comprising, a first balance element coupled to a terminal at one end, a second balance element coupled to another terminal at one end, the second balance element having a shape mirroring a shape of the first balance element, wherein each of the balance elements is made of a generally conductive material, and a ground element situated between the first balance element and the second balance element; and a timed splitter/combiner circuit coupled to the plurality of antennas and configured to steer a beam associated with the plurality of antennas, wherein one of the antennas further comprises:

a conductive loop connected to the first balance element and the second balance element, wherein a middle section of the conductive loop is situated behind one end of the ground element.

13. A method of transmitting signals over an Ultra Wide Bandwidth (UWB) frequency spectrum, the method comprising receiving an input source signal at a transmitter; and radiating a transmission signal at a plurality of terminals in response to the source signal using a UWB antenna, the UWB antenna comprising a plurality of balance elements and a ground element disposed between the plurality of balance elements, the balance elements being coupled to terminals, the ground element housing the transmitter, wherein one of the plurality of balance elements has a shape that mirrors another one of the plurality of balance elements, each of the balance elements being made of a generally conductive material.

14. The method of claim 13, wherein the ground element in the step of radiating has a triangular shape with a base that is oriented towards the terminals.

15. The method of claim 13, further comprising:

maintaining a smooth impedance transition based upon a physical configuration of the balance elements and the ground element.

16. The method of claim 13, wherein the step of radiating comprises:

splitting the received light source signal into a plurality of signal components;

amplifying one of the signal components;

delaying another one of the signal components based on the amplifying step; and amplifying the other signal component, wherein the one signal component and the other signal components have matched amplitudes and are 180 degrees out of phase.

17. A method of receiving signals over an Ultra Wide Bandwidth (UWB) frequency spectrum, the method comprising:

receiving the signals via a UWB antenna, the UWB antenna comprising a plurality of balance elements and a ground element disposed between the plurality of balance elements, the balance elements being coupled to terminals, the ground element housing the transmitter, wherein one of the plurality of balance elements has a shape that mirrors another one of the plurality of balance elements, each of the balance elements being made of a generally conductive material; and outputting a differential signal based upon the receiving step.

18. The method of claim 17, wherein the ground element in the step of receiving has a triangular shape with a base that is oriented towards the terminals.

19. The method of claim 17, further comprising:

maintaining a smooth impedance transition based upon a physical configuration of the balance elements and the ground element.

20. The method of claim 17, wherein the step of outputting comprises:

amplifying one of the signals;

amplifying another one of the signals;

delaying the other one of the signals based upon the step of amplifying the one signal; and summing the one signal and the other signal, wherein the one signal component and the other signal component have matched amplitudes and are 180 degrees out of phase.

* * * * *